US011283191B2

(12) United States Patent
Onaka et al.

(10) Patent No.: US 11,283,191 B2
(45) Date of Patent: Mar. 22, 2022

(54) ANTENNA ARRAY AND ANTENNA MODULE

(71) Applicant: Murata Manufacturing Co., Ltd., Kyoto (JP)

(72) Inventors: Kengo Onaka, Kyoto (JP); Tadashi Sugahara, Kyoto (JP); Yoshiki Yamada, Kyoto (JP); Hirotsugu Mori, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 5 days.

(21) Appl. No.: 16/912,803

(22) Filed: Jun. 26, 2020

(65) Prior Publication Data

US 2020/0328531 A1 Oct. 15, 2020

Related U.S. Application Data

(63) Continuation of application No. PCT/JP2018/039630, filed on Oct. 25, 2018.

(30) Foreign Application Priority Data

Dec. 28, 2017 (JP) ..... JP2017-252770

(51) Int. Cl.
*H01Q 21/06* (2006.01)
*H01Q 1/48* (2006.01)
*H01Q 1/52* (2006.01)

(52) U.S. Cl.
CPC ..... *H01Q 21/065* (2013.01); *H01Q 1/48* (2013.01); *H01Q 1/52* (2013.01)

(58) Field of Classification Search
CPC ..... H01Q 1/38–1/52; H01Q 21/065
See application file for complete search history.

(56) References Cited

U.S. PATENT DOCUMENTS 7,079,079 B2 * 7/2006 Jo ..... H01Q 1/243 343/700 MS
2007/0285336 A1 12/2007 Kamgaing
(Continued)

FOREIGN PATENT DOCUMENTS

CN 106848583 A 6/2017
CN 107437655 A 12/2017
(Continued)

OTHER PUBLICATIONS

Notice of Reasons for Rejection for JP Application No. 2019-562791 dated Mar. 23, 2021.
(Continued)

*Primary Examiner* — Hasan Islam
(74) *Attorney, Agent, or Firm* — Pearne & Gordon LLP

(57) ABSTRACT

In an antenna array of the present disclosure, in a plan view from a direction that is normal to an isolation element, the isolation element is formed between a first antenna element and a second antenna element. A first distance between the first antenna element and a first ground electrode is different from a second distance between the isolation element and the first ground electrode. A third distance between the second antenna element and the first ground electrode is different from the second distance. In a plan view from a direction that is normal to the first antenna element, the isolation element is spaced apart from the first antenna element. In a plan view from a direction that is normal to the second antenna element, the isolation element is spaced apart from the second antenna element.

15 Claims, 14 Drawing Sheets

(56) References Cited

U.S. PATENT DOCUMENTS

| | | | | |
|---|---|---|---|---|
| 2008/0088510 | A1 | 4/2008 | Murata et al. | |
| 2008/0174508 | A1 | 7/2008 | Iwai et al. | |
| 2017/0229769 | A1 | 8/2017 | Yokoyama et al. | |
| 2017/0264012 | A1 | 9/2017 | Clark et al. | |
| 2017/0346180 | A1 | 11/2017 | Takahashi et al. | |
| 2017/0352945 | A1* | 12/2017 | Chang | H01Q 1/36 |
| 2019/0006745 | A1 | 1/2019 | Suematsu et al. | |
| 2020/0052396 | A1 | 2/2020 | Sakai et al. | |

FOREIGN PATENT DOCUMENTS

| | | | |
|---|---|---|---|
| JP | 2007037162 | A | 2/2007 |
| JP | 2007-243375 | A | 9/2007 |
| JP | 2008199588 | A | 8/2008 |
| JP | 2012065371 | A | 3/2012 |
| JP | 2013046291 | A | 3/2013 |
| JP | 2016174291 | A | 9/2016 |
| JP | 2018186482 | A | 11/2018 |
| WO | 2016067969 | A1 | 5/2016 |
| WO | 2017/033525 | A1 | 3/2017 |

OTHER PUBLICATIONS

Office Action for Chinese Patent Application No. 201880084467.5 dated Dec. 18, 2020.
International Search Report issued in Application No. PCT/JP2018/039630, dated Jan. 15, 2019.
Written Opinion issued in Application No. PCT/JP2018/039630, dated Jan. 15, 2019.

* cited by examiner

| Gap [mm] | W [mm] | RL [dB] | Iso [dB] |
|---|---|---|---|
| 0 | 2.2 | 1.7 | 10.5 |
| 0.2 | 1.8 | 3.6 | 21.1 |
| 0.3 | 1.6 | 4.8 | 27.2 |
| 0.4 | 1.4 | 5.7 | 24.2 |
| 0.5 | 1.2 | 6.3 | 22.5 |
| 0.6 | 1.0 | 6.4 | 21.6 |
| 0.7 | 0.8 | 6.4 | 21.0 |
| 0.8 | 0.6 | 6.4 | 20.6 |
| 0.9 | 0.4 | 6.3 | 20.4 |
| 1.0 | 0.2 | 6.3 | 20.2 |
| 1.1 | 0 | 6.3 | 20.2 |

| Gap [mm] | W [mm] | RL [dB] | Iso [dB] |
|---|---|---|---|
| 0 | 2.2 | – | – |
| 0.2 | 1.8 | 2.8 | 14.8 |
| 0.3 | 1.6 | 4.1 | 20.1 |
| 0.4 | 1.4 | 5.2 | 22.5 |
| 0.5 | 1.2 | 6.0 | 23.7 |
| 0.6 | 1.0 | 6.4 | 22.3 |
| 0.7 | 0.8 | 6.5 | 21.4 |
| 0.8 | 0.6 | 6.4 | 20.9 |
| 0.9 | 0.4 | 6.4 | 20.5 |
| 1.0 | 0.2 | 6.4 | 20.3 |
| 1.1 | 0 | 6.3 | 20.2 |

ANTENNA ARRAY AND ANTENNA MODULE

This is a continuation of International Application No. PCT/JP2018/039630 filed on Oct. 25, 2018 which claims priority from Japanese Patent Application No. 2017-252770 filed on Dec. 28, 2017. The contents of these applications are incorporated herein by reference in their entireties.

BACKGROUND

Technical Field

The present disclosure relates to an antenna array and an antenna module.

In the related art, an antenna module in which antenna elements are regularly arranged and an antenna module that includes such an antenna array are known. For example, International Publication No. 2016/067969 (Patent Document 1) discloses an antenna consisting of a conductor pattern and a radio-frequency semiconductor element that supplies a radio-frequency signal to the antenna.

Patent Document 1: International Publication No. 2016/067969

BRIEF SUMMARY

However, in the antenna array disclosed in Patent Document 1, a plurality of antenna elements are arranged in a limited mounting space and consequently the antenna elements are close to each other and electromagnetic coupling between the antenna elements is strengthened. As a result, the isolation characteristic of the antenna array may deteriorate.

The present disclosure improves the isolation characteristic of an antenna array.

An antenna array according to an embodiment of the present disclosure includes a dielectric substrate, a first antenna element, a second antenna element, an isolation element, and a first ground electrode. The first antenna element is shaped like a flat plate. The first antenna element is formed on or in the dielectric substrate. The second antenna element is shaped like a flat plate. The second antenna element is formed on or in the dielectric substrate. The isolation element is formed on or in the dielectric substrate. The first ground electrode is formed on or in the dielectric substrate. The first ground electrode faces each of the first antenna element, the second antenna element, and the isolation element via at least part of the dielectric substrate. In a plan view from a first normal direction that is normal to a main surface of the isolation element, the isolation element is formed between the first antenna element and the second antenna element. A distance between the first antenna element and the first ground electrode is different from a distance between the isolation element and the first ground electrode. A distance between the second antenna element and the first ground electrode is different from a distance between the isolation element and the first ground electrode. In a plan view from a second normal direction that is normal to a main surface of the first antenna element, the isolation element is spaced apart from the first antenna element. In a plan view from a third normal direction that is normal to a main surface of the second antenna element, the isolation element is spaced apart from the second antenna element.

According to the antenna array of the embodiment of the present disclosure, electromagnetic coupling between the first antenna element and the second antenna element is weakened by the isolation element and therefore the isolation characteristic of the antenna array can be improved.

DETAILED DESCRIPTION

Figure 1:
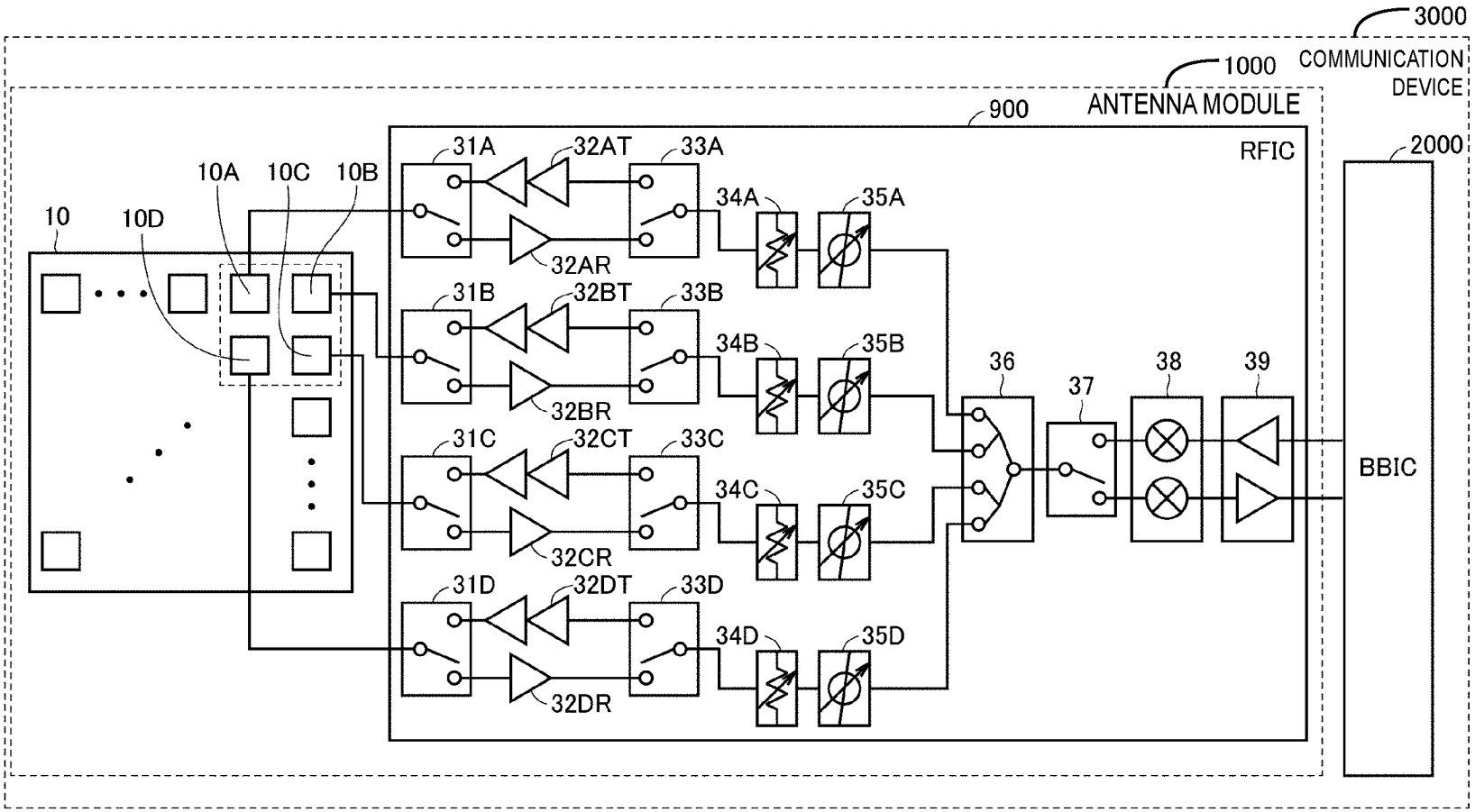
FIG. 1 is a block diagram of a communication device that includes an antenna array.

Hereafter, embodiments will be described in detail while referring to the drawings. In the figures, generally, identical or corresponding parts are denoted by the same symbols and repeated description thereof is omitted.

FIG. 1 is a block diagram of a communication device 3000 that includes an antenna array 10. The communication device 3000 is for example a mobile terminal such as a mobile phone, a smart phone, or a tablet, a personal computer having a communication function, and so on.

As illustrated in FIG. 1, the communication device 3000 includes an antenna module 1000 and a baseband integrated circuit (BBIC) 2000 that forms a baseband signal processing circuit. The antenna module 1000 includes a radio-frequency integrated circuit (RFIC) 900 or like radio-frequency processing circuit, which is an example of a radio-frequency element, and the antenna array 10.

The communication device 3000 up converts a signal, which has been transmitted from the BBIC 2000 to the antenna module 1000, into a radio-frequency signal and radiates the radio-frequency signal from the antenna array 10. The communication device 3000 down converts a radio-frequency signal received by the antenna array 10 and performs signal processing on the radio-frequency signal in the BBIC 2000.

A plurality of flat-plate-shaped antenna elements (radiating conductors) are regularly arranged in the antenna array 10. In FIG. 1, the configuration of the part of the RFIC 900 corresponding to antenna elements 10A to 10D out of the plurality of antenna elements forming the antenna array 10 is illustrated.

The RFIC 900 includes switches 31A to 31D, 33A to 33D, and 37, power amplifiers 32AT to 32DT, low-noise amplifiers 32AR to 32DR, attenuators 34A to 34D, phase shifters 35A to 35D, a signal multiplexer/demultiplexer 36, a mixer 38, and an amplification circuit 39.

The RFIC 900, for example, is formed as a one chip integrated circuit component that includes circuit elements (switches, power amplifiers, low-noise amplifiers, attenuators, and phase shifters) corresponding to the plurality of antenna elements included in the antenna array 10. Alternatively, the circuit elements may be formed as a one chip integrated circuit component for each antenna element separately from the RFIC 900.

In the case where a radio-frequency signal is to be received, the switches 31A to 31D and 33A to 33D are switched to the low-noise amplifiers 32AR to 32DR and the switch 37 is connected to a reception-side amplifier of the amplification circuit 39.

Radio-frequency signals received by the antenna elements 10A to 10D pass along signal paths from the switches 31A to 31D to the phase shifters 35A to 35D, are multiplexed by the signal multiplexer/demultiplexer 36, and the resulting signal is down-converted by the mixer 38, amplified by the amplification circuit 39, and transmitted to the BBIC 2000.

In the case where a radio-frequency signal is to be transmitted from the antenna array 10, the switches 31A to 31D and 33A to 33D are switched to the power amplifiers 32AT to 32DT and the switch 37 is connected to a transmission-side amplifier of the amplification circuit 39.

A signal transmitted from the BBIC 2000 is amplified by the amplification circuit 39 and up-converted by the mixer 38. The up-converted radio-frequency signal is divided into four signals by the signal multiplexer/demultiplexer 36 and the resulting signals pass along the signal paths from the phase shifters 35A to 35D to the switches 31A to 31D and are supplied to the antenna elements 10A to 10D. At this time, the directivity of the antenna array 10 can be adjusted by individually adjusting the phases of the phase shifters 35A to 35D arranged on the respective signal paths.

Part of a radio-frequency signal output from the BBIC 2000 and radiated from any one of the antenna elements 10A to 10D may be received by another antenna element and return to the BBIC 2000. For example, radio-frequency signals radiated from the antenna elements 10B to 10D may be received by the antenna element 10A and return to the BBIC 2000. In such a case, since a radio-frequency signal output from the BBIC 2000 to the antenna element 10A appears to return to the BBIC 2000, the reflection characteristic of the antenna element 10A alone deteriorates.

Even if impedance matching is performed for each of the antenna elements 10A to 10D and the reflection characteristic of each antenna element as a standalone unit is improved, when a radio-frequency signal radiated from another antenna element is received by an antenna element, the effect of impedance matching is reduced and the reflection characteristic of that antenna element deteriorates. The isolation characteristic of the antenna array 10 has to be improved in order to suppress deterioration of the reflection characteristics of impedance matched antenna elements.

Such deterioration of the reflection characteristics becomes more significant as the number of antenna elements included in the antenna array 10 increases, because the influence of other antenna elements on any one antenna element increases. Furthermore, deterioration of the reflection characteristics for example affects the performances of the power amplifiers 32AT to 32DT in terms of distortion, power consumption, and so on. Therefore, particularly in a configuration in which there are a large number of antenna elements included in the antenna array 10, it is important to improve the isolation characteristic of the antenna array 10.

Accordingly, in an embodiment, isolation elements are arranged between the antenna elements in order weaken the electromagnetic coupling between the antenna elements. As a result, the isolation characteristic of the antenna array can be improved.

Embodiment 1

Figure 2:
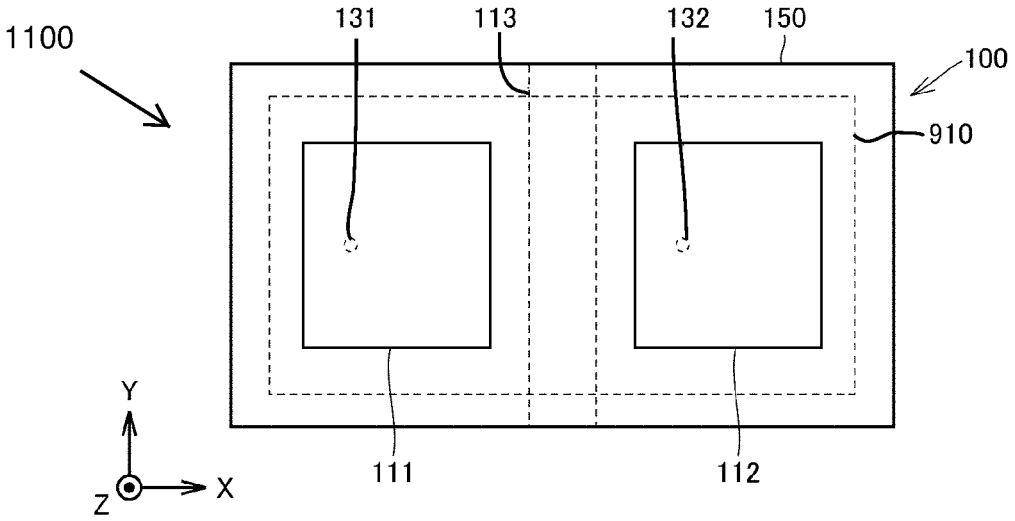
FIG. 2 is a plan view of an antenna module including an antenna array according to embodiment 1 from a Z-axis direction.
Figure 3:
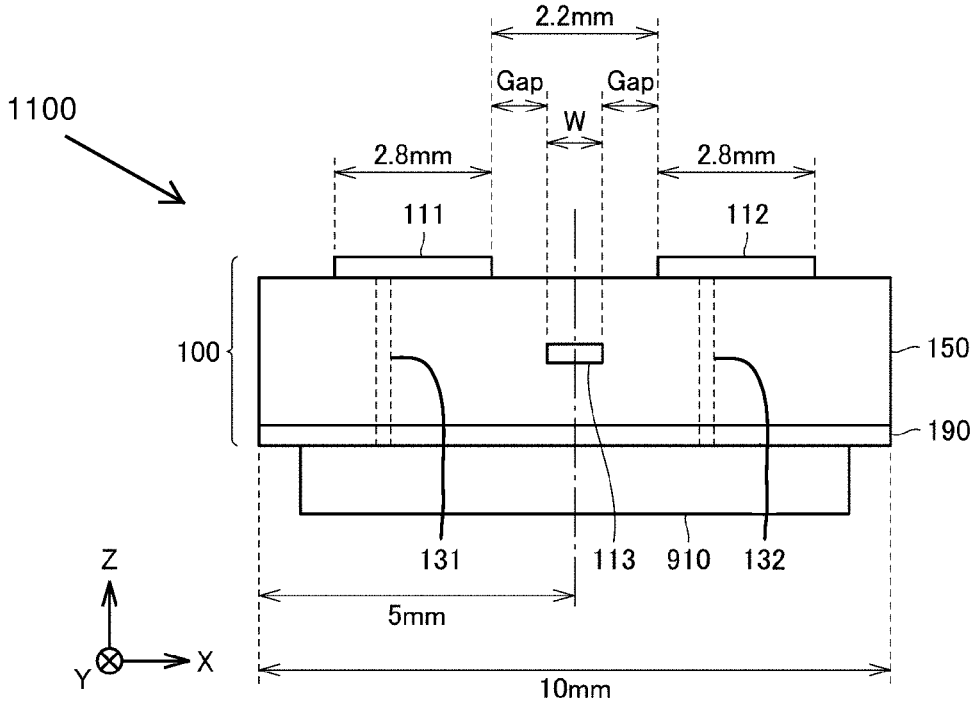
FIG. 3 is a plan view of the antenna module in FIG. 2 from a Y-axis direction.

FIG. 2 is a plan view of an antenna module 1100 including an antenna array 100 according to embodiment 1 from a Z-axis direction. FIG. 3 is a plan view of the antenna module 1100 in FIG. 2 from a Y-axis direction. In FIGS. 2 and 3, the X axis, the Y axis, and the Z axis are perpendicular to one another. The same applies to FIGS. 7, 8, and 12 to 18.

The antenna module 1100 transmits and receives radio-frequency signals in a usage frequency band of 26-30 GHz and mainly at a usage frequency of 30 GHz. The usage frequency band of the antenna module including the antenna array according to the embodiment is not limited to 26-30 GHz and for example may be 26.5-29.5 GHz. Hereafter, the wavelength of the usage frequency will also be referred to as a specific wavelength. In the case where the usage frequency is 30 GHz, the specific wavelength is approximately 10 (9.9930 . . . ) mm Referring to FIGS. 2 and 3, the antenna module 1100 includes the antenna array 100 and an RFIC 910. The antenna array 100 includes flat-plate-shaped antenna elements 111 and 112, a flat-plate-shaped isolation element 113 (e.g., an electrical isolator), a dielectric substrate 150, and a ground electrode 190.

In FIG. 3, a width W represents the width of the isolation element 113 in the X-axis direction. A spacing Gap represents the spacing between the isolation element 113 and the antenna element 111 in the X-axis direction and the spacing between the isolation element 113 and the antenna element 112 in the X-axis direction. The value of W+2× Gap equals 2.2 mm.

The antenna element 111 faces the ground electrode 190 with the dielectric substrate 150 interposed therebetween. The antenna element 112 faces the ground electrode 190 with the dielectric substrate 150 interposed therebetween. In a plan view from a direction normal to the isolation element 113 (Z-axis direction), the isolation element 113 is formed between the antenna element 111 and the antenna element 112. The isolation element 113 faces the ground electrode 190 with at least part of the dielectric substrate 150 interposed therebetween.

The distance between the antenna element 111 and the ground electrode 190 is larger than the distance between the isolation element 113 and the ground electrode 190. The distance between the antenna element 112 and the ground electrode 190 is larger than the distance between the isolation element 113 and the ground electrode 190. However, the relationship between the distances between the antenna elements and the ground electrode and the distance between the isolation element and the ground electrode is not limited to this example. For example, the distance between the isolation element 113 and the ground electrode 190 may be larger than the distance between the antenna element 111 and the ground electrode 190 and the distance between the antenna element 112 and the ground electrode 190.

In a plan view from a direction normal to the antenna element 111 (Z-axis direction), the isolation element 113 is spaced apart from the antenna element 111. Furthermore, in a plan view from a direction normal to the antenna element 112 (Z-axis direction), the isolation element 113 is spaced apart from the antenna element 112.

The ground electrode 190 is formed between the dielectric substrate 150 and the RFIC 910. In a plan view from the Z-axis direction, the antenna element 111 and the antenna element 112 both overlap the RFIC 910.

A via conductor 131 penetrates through the ground electrode 190 and connects the antenna element 111 and the RFIC 910 to each other. The via conductor 131 is insulated from the ground electrode 190. A via conductor 132 penetrates through the ground electrode 190 and connects the antenna element 112 and the RFIC 910 to each other. The via conductor 132 is insulated from the ground electrode 190. The RFIC 910 supplies radio-frequency signals to the antenna elements 111 and 112 through the via conductors 131 and 132.

Figures 4, 5:
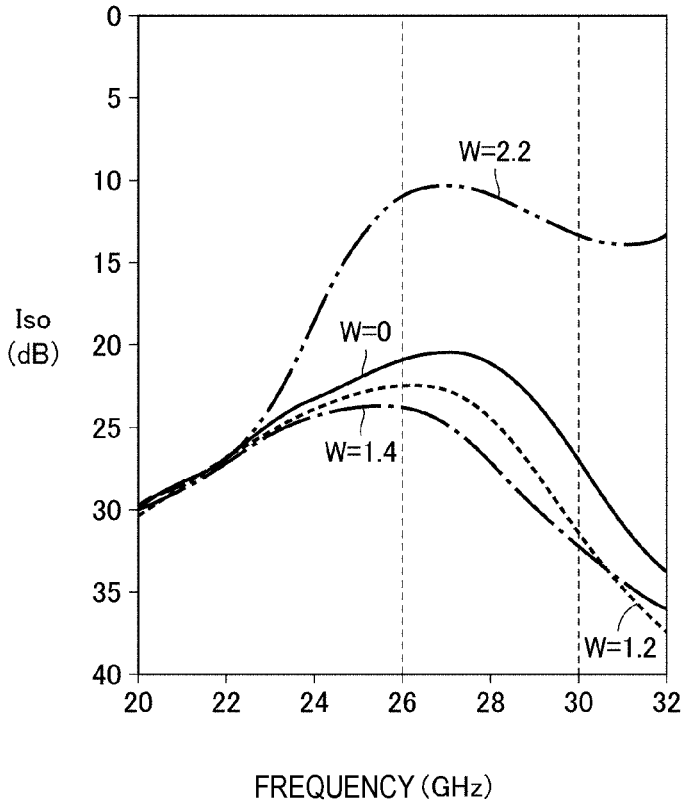
FIG. 4 is a table illustrating simulation results of return loss of antenna elements and simulation results of isolation between antenna elements when the width of an isolation element illustrated in FIG. 3 is changed.
FIG. 5 is a diagram illustrating isolation characteristics for cases where the width W of the isolation element in FIG. 3 is 0 mm, 1.2 mm, 1.4 mm, and 2.2 mm.
Figure 6:
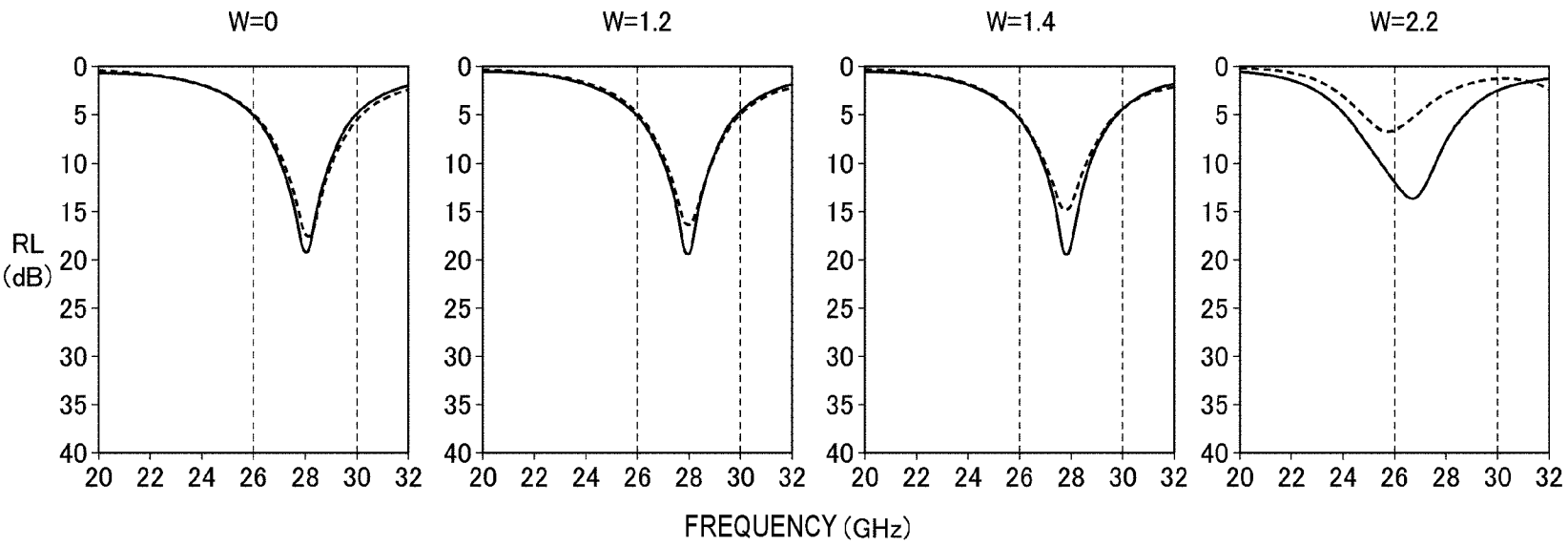
FIG. 6 is a diagram illustrating the reflection characteristics of antenna elements in cases where the width of the isolation element in FIG. 3 is 0 mm, 1.2 mm, 1.4 mm, and 2.2 mm.

FIG. 4 is a table illustrating simulation results of return loss (RL) of the antenna element 111 and the antenna element 112 and simulation results of isolation (Iso) between the antenna element 111 and the antenna element 112 when the width W of the isolation element 113 illustrated in FIG. 3 is changed. FIG. 5 is a diagram illustrating isolation characteristics for cases where the width W of the isolation element 113 in FIG. 3 is 0 mm, 1.2 mm, 1.4 mm, and 2.2 mm. FIG. 6 is a diagram illustrating the reflection characteristic of the antenna element 111 (solid line) and the reflection characteristic of the antenna element 112 (broken line) in cases where the width of the isolation element 113 in FIG. 3 is 0 mm, 1.2 mm, 1.4 mm, and 2.2 mm.

A large return loss means that means the signal amount emitted from an antenna element is large. In other words, the reflection characteristic of the antenna element becomes more favorable as the return loss increases. Furthermore, as the isolation value increases, the electromagnetic coupling between the antenna element 111 and the antenna element 112 weakens and transmission of a signal between the antenna element 111 and the antenna element 112 is suppressed. In other words, this means that the isolation characteristic of the antenna array 100 becomes more favorable as the isolation increases.

The smallest value out of the return loss of the antenna element 111 and the return loss of the antenna element 112 in the usage frequency band of the antenna module 1100 is illustrated as the value of the return loss in FIG. 4. The smallest value in the usage frequency band of the antenna module 1100 is illustrated as the value of isolation in FIG. 4.

In FIG. 4, in the first row where the width W is 2.2 mm, data is illustrated for the case where the antenna element 111 and the isolation element 113 are not spaced apart from each other and the antenna element 112 and the isolation element 113 are not spaced apart from each other (spacing Gap is 0 mm) in a plan view of the antenna module 1100 from the Z-axis direction. In addition, in the final row where the width W is 0 mm, data of a comparative example in which the isolation element 113 is not arranged is illustrated.

As illustrated in FIG. 4, the isolation when the spacing Gap is from 0.2 mm to 1.0 mm is greater than or equal to the isolation in the comparative example in which the spacing Gap is 1.1 mm. Furthermore, the difference between the return loss when the spacing Gap is from 0.5 mm to 1.0 mm and the return loss in the comparative example is around 0.1 dB at maximum. In a comparison with the comparative example in which the spacing Gap is 1.1 mm, it is desirable that the spacing Gap be greater than or equal to 1/20 (0.4996 . . . ) of the specific wavelength from the viewpoint of maintaining the reflection characteristic.

According to the antenna array of embodiment 1 described above, the isolation characteristic can be improved.

Embodiment 2

In embodiment 1, a case was described in which a first antenna element, a second antenna element, and an isolation element are not formed on the same plane. In embodiment 2, a case will be described in which a first antenna element, a second antenna element, and an isolation element are formed on the same plane.

Figure 7:
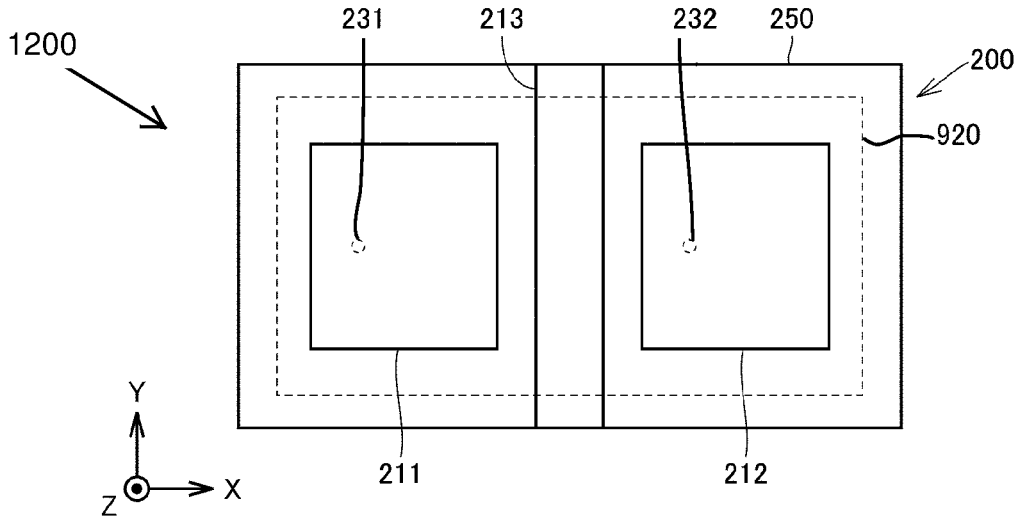
FIG. 7 is a plan view of an antenna module including an antenna array according to embodiment 2 from a Z-axis direction.
Figure 8:
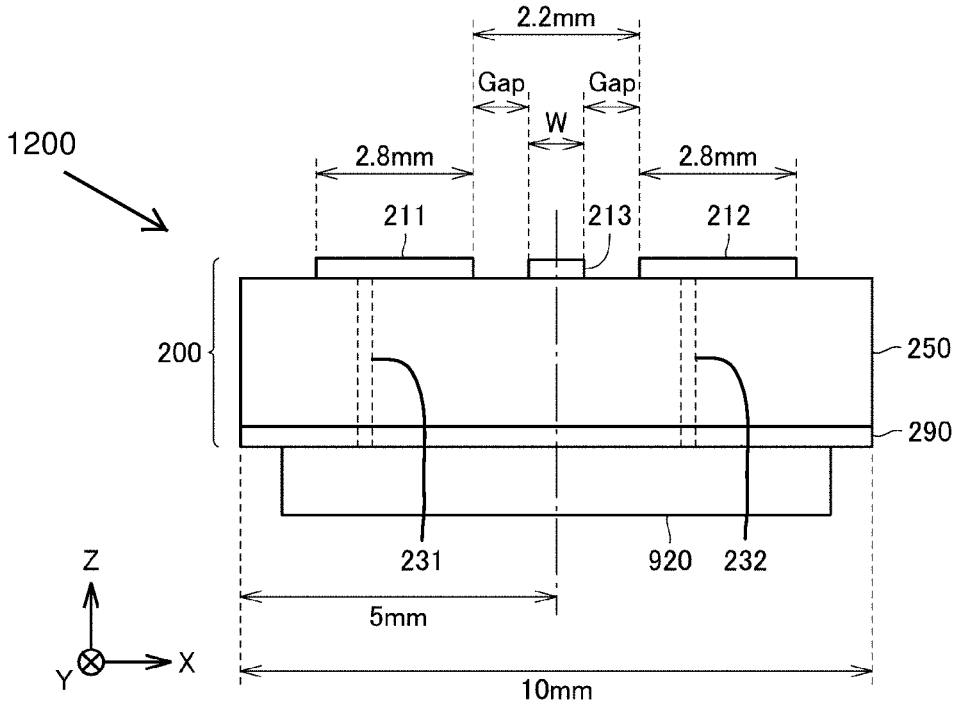
FIG. 8 is a plan view of the antenna module in FIG. 7 from a Y-axis direction.

FIG. 7 is a plan view of an antenna module 1200 including an antenna array 200 according to embodiment 2 from the Z-axis direction. FIG. 8 is a plan view of the antenna module 1200 in FIG. 7 from the Y-axis direction. The antenna module 1200 transmits and receives radio-frequency signals with a usage frequency band of 26-30 GHz and mainly with a usage frequency of 30 GHz.

Referring to FIGS. 7 and 8, the antenna module 1200 includes the antenna array 200 and an RFIC 920. The antenna array 200 includes flat-plate-shaped antenna elements 211 and 212, a flat-plate-shaped isolation element 213, a dielectric substrate 250, and a ground electrode 290.

In FIG. 8, a width W represents the width of the isolation element 213 in the X-axis direction. A spacing Gap represents the spacing between the isolation element 213 and the antenna element 211 in the X-axis direction and the spacing between the isolation element 213 and the antenna element 212 in the X-axis direction. The value of W+2× Gap equals 2.2 mm.

The antenna element 211 faces the ground electrode 290 with the dielectric substrate 250 interposed therebetween. The antenna element 212 faces the ground electrode 290 with the dielectric substrate 250 interposed therebetween. In a plan view from a direction normal to the isolation element 213 (Z-axis direction), the isolation element 213 is formed between the antenna element 211 and the antenna element 212. The isolation element 213 faces the ground electrode 290 with the dielectric substrate 250 interposed therebetween.

The distance between the antenna element 211 and the ground electrode 290 is equal to the distance between the isolation element 213 and the ground electrode 290. The distance between the antenna element 212 and the ground electrode 290 is equal to the distance between the isolation element 213 and the ground electrode 290. In other words, the antenna element 211, the antenna element 212, and the isolation element 213 are formed on the same plane (surface of dielectric substrate 250).

In addition, in a plan view from a direction normal to the antenna element 211 (Z-axis direction), the isolation element 213 is spaced apart from the antenna element 211 by at least 1/20 the specific wavelength. In addition, in a plan view from a direction normal to the antenna element 212 (Z-axis direction), the isolation element 213 is spaced apart from the antenna element 212 by at least 1/20 the specific wavelength.

The ground electrode 290 is formed between the dielectric substrate 250 and the RFIC 920. In a plan view from the Z-axis direction, the antenna element 211 and the antenna element 212 both overlap the RFIC 920.

A via conductor 231 penetrates through the ground electrode 290 and connects the antenna element 211 and the RFIC 920 to each other. The via conductor 231 is insulated from the ground electrode 290. A via conductor 232 penetrates through the ground electrode 290 and connects the antenna element 212 and the RFIC 920 to each other. The via conductor 232 is insulated from the ground electrode 290. The RFIC 920 supplies radio-frequency signals to the antenna elements 211 and 212 through the via conductors 231 and 232.

Figures 9, 10:
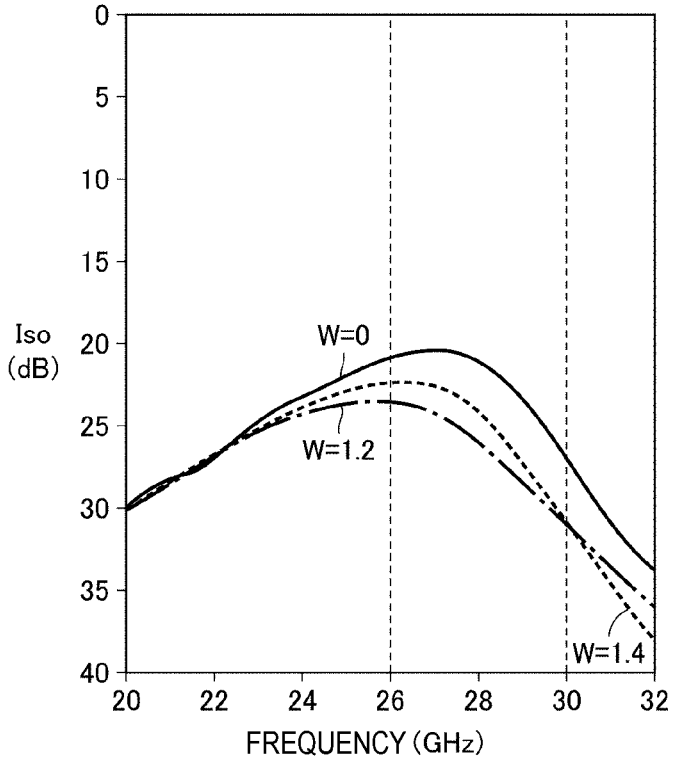
FIG. 9 is a table illustrating simulation results of return loss of an antenna element and simulation results of isolation between antenna elements when the width of an isolation element illustrated in FIG. 8 is changed.
FIG. 10 is a diagram illustrating isolation characteristics for cases where the width W of the isolation element in FIG. 8 is 0 mm, 1.2 mm, and 1.4 mm.
Figure 11:
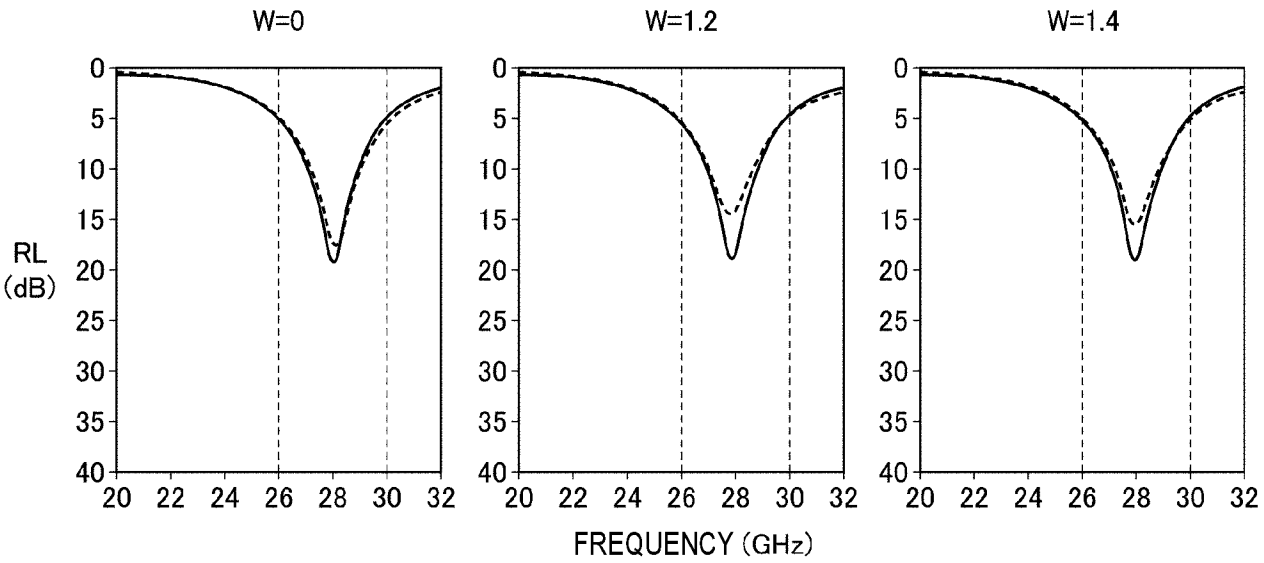
FIG. 11 is a diagram illustrating the reflection characteristics of antenna elements in cases where the width of the isolation element in FIG. 8 is 0 mm, 1.2 mm, and 1.4 mm.

FIG. 9 is a table illustrating simulation results of the return loss of the antenna element 212 and simulation results of isolation between the antenna element 211 and the antenna element 212 when the width W of the isolation element 213 illustrated in FIG. 8 is changed. FIG. 10 is a diagram illustrating isolation characteristics for cases where the width W of the isolation element 213 in FIG. 8 is 0 mm, 1.2 mm, and 1.4 mm. FIG. 11 is a diagram illustrating the reflection characteristic of the antenna element 211 (solid line) and the reflection characteristic of the antenna element 212 (broken line) in cases where the width of the isolation element 213 in FIG. 8 is 0 mm, 1.2 mm, and 1.4 mm.

The smallest value out of the return loss of the antenna element 211 and the return loss of the antenna element 212 in the usage frequency band of the antenna module 1200 is illustrated as the value of the return loss in FIG. 9. The smallest value in the usage frequency band of the antenna module 1200 is illustrated as the value of isolation in FIG. 9.

In FIG. 9, the return loss and isolation are not illustrated in the first row in which the width W of the isolation element 213 is 2.2 mm. Since the antenna element 211, the antenna element 212, and the isolation element 213 are disposed on the same plane in the antenna module 1200, in the case where the width W of the isolation element 213 is 2.2 mm, the antenna element 211 would contact the isolation element 213 and the antenna element 212 would contact the isolation element 213. Therefore, the case where the width W is 2.2 mm is eliminated from the simulation. In addition, in the final row where the width W is 0 mm, data of a comparative example in which the isolation element 213 is not arranged is illustrated.

As illustrated in FIG. 9, the isolation when the spacing Gap is from 0.5 mm to 1.0 mm is greater than the isolation in the comparative example in which the spacing Gap is 1.1 mm. The difference between the return loss when the spacing Gap is from 0.5 mm to 1.0 mm and the return loss in the comparative example is around 0.3 dB at maximum.

In other words, the isolation characteristic of the antenna array 200 can be improved by making the spacing Gap be greater than or equal to 1/20 the specific wavelength when the isolation element is formed on the same plane as the antenna elements. In addition, the reflection characteristic of the antenna array 200 can be maintained in a comparison with the comparative example in which the spacing Gap is 1.1 mm by making the spacing Gap be greater than or equal to 1/20 the specific wavelength.

According to the antenna array of embodiment 2 described above, the isolation characteristic can be improved.

Embodiment 3

In embodiment 1, a case has been described in which the isolation element is formed inside the dielectric substrate. In embodiment 3, a case will be described in which the isolation element is arranged on a surface of the dielectric substrate by forming the isolation element at the bottom of a slit formed in the dielectric substrate.

Figure 12:
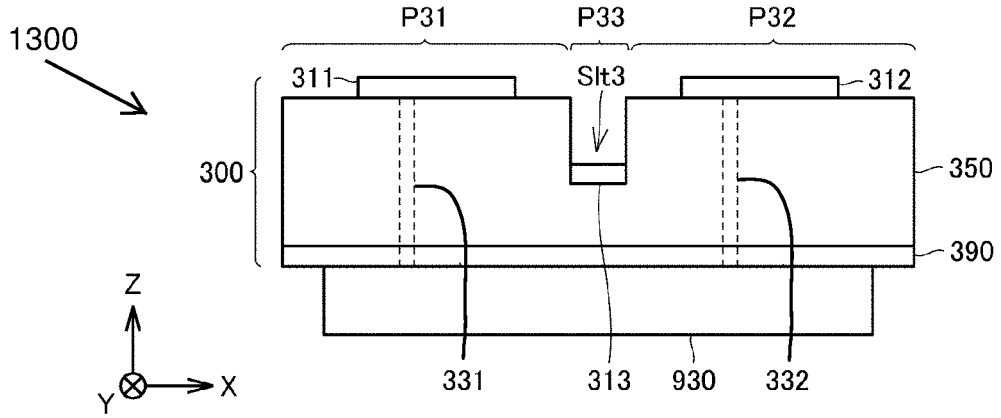
FIG. 12 is a plan view of an antenna module according to embodiment 3 from a Y-axis direction.

FIG. 12 is a plan view of an antenna module 1300 according to embodiment 3 from the Y-axis direction. As illustrated in FIG. 12, the antenna module 1300 includes an antenna array 300 and an RFIC 930.

The antenna array 300 includes flat-plate-shaped antenna elements 311 and 312, a flat-plate-shaped isolation element 313, a dielectric substrate 350, and a ground electrode 390.

The antenna element 311 faces the ground electrode 390 with the dielectric substrate 350 interposed therebetween. The antenna element 312 faces the ground electrode 390 with the dielectric substrate 350 interposed therebetween. In a plan view from a direction normal to the isolation element 313 (Z-axis direction), the isolation element 313 is formed between the antenna element 311 and the antenna element 312. The isolation element 313 faces the ground electrode 390 with the dielectric substrate 350 interposed therebetween.

The dielectric substrate 350 includes a part P31, a part P32, and a part P33. The part P33 connects the part P31 and the part P32 to each other. The thickness of the part P31 in the Z-axis direction (direction normal to antenna element 311) is larger than the thickness of the part P33 in the Z-axis direction. The thickness of the part P32 in the Z-axis direction (direction normal to antenna element 312) is larger than the thickness of the part P33 in the Z-axis direction. A slit Slt3 is formed in the dielectric substrate 350 along the Y-axis direction between the part P31 and the part P32.

The antenna element 311 is formed on a surface of the part P31. The antenna element 312 is formed on a surface of the part P32. The antenna element 313 is formed on a surface of the part P33. The width (size in X-axis direction) of the slit Slt3 and the width (size in X-axis direction) of the isolation element 313 do not have to be identical and may be different from each other. In other words, the isolation element 313 may be formed on part of the bottom of the slit Slt3 or part of the isolation element 313 may be exposed from the bottom surface of the slit Slt3.

The effective dielectric constant of the dielectric substrate 350 in which the slit Slt3 is formed is smaller than the effective dielectric constant would be if the slit Slt3 were not formed. It is more difficult for a radio-frequency signal to pass through the slit Slt3, which is not filled with the dielectric, than through the dielectric substrate 350. The isolation of the antenna element 311 and the antenna element 312 can be further improved by forming the slit Slt3 in the dielectric substrate 350.

The distance between the antenna element 311 and the ground electrode 390 is larger than the distance between the isolation element 313 and the ground electrode 390. The distance between the antenna element 312 and the ground electrode 390 is larger than the distance between the isolation element 313 and the ground electrode 390.

In a plan view from the Z-axis direction, the isolation element 313 is spaced apart from the antenna element 311. In a plan view from the Z-axis direction, the isolation element 313 is spaced apart from the antenna element 312.

The ground electrode 390 is formed between the dielectric substrate 350 and the RFIC 930. In a plan view from the Z-axis direction, the antenna element 311 and the antenna element 312 both overlap the RFIC 930.

A via conductor 331 penetrates through the ground electrode 390 and connects the antenna element 311 and the RFIC 930 to each other. The via conductor 331 is insulated from the ground electrode 390. A via conductor 332 penetrates through the ground electrode 390 and connects the antenna element 312 and the RFIC 930 to each other. The via conductor 332 is insulated from the ground electrode 390. The RFIC 930 supplies radio-frequency signals to the antenna elements 311 and 312 through the via conductors 331 and 332.

According to the antenna array of embodiment 3 described above, the isolation characteristic can be improved.

Embodiment 4

In embodiments 1 to 3, a case has been described in which the first antenna element overlaps the radio-frequency element in a plan view from a direction normal to the first antenna element and the second antenna element overlaps the radio-frequency element in a plan view from a direction normal to the second antenna element. In embodiment 4, a case will be described in which a second antenna element overlaps a radio-frequency element in a plan view from a direction normal to the second antenna element, but a first antenna element does not overlap a radio-frequency element in a plan view from a direction normal to the first antenna element.

Figure 13:
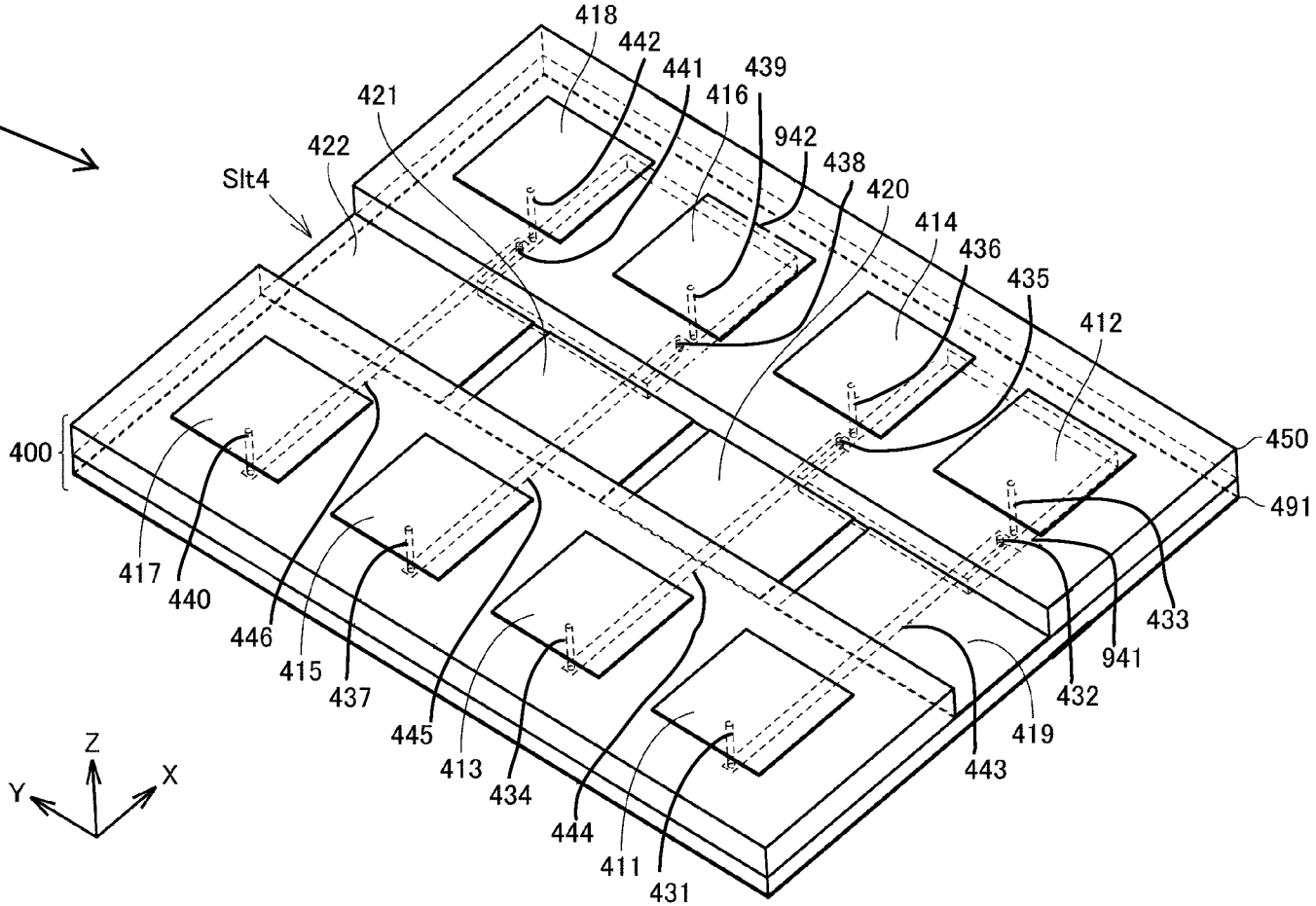
FIG. 13 is an external perspective view of an antenna module according to embodiment 4.
Figure 14:
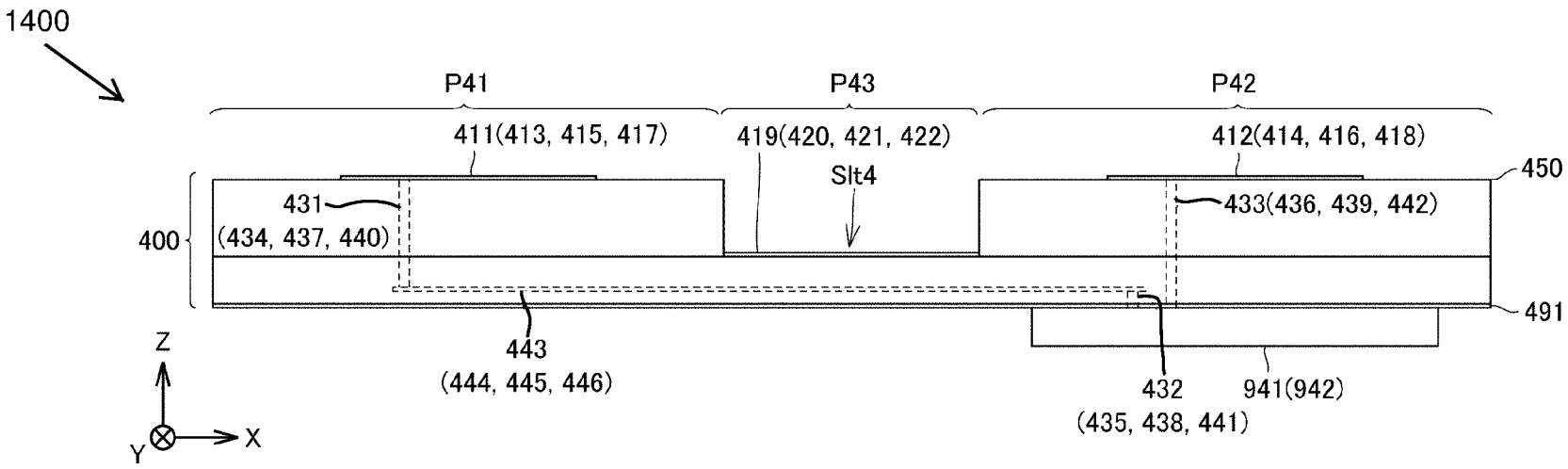
FIG. 14 is a plan view of the antenna module in FIG. 13 from a Y-axis direction.

FIG. 13 is an external perspective view of an antenna module 1400 according to embodiment 4. FIG. 14 is a plan view of the antenna module 1400 in FIG. 13 from the Y-axis direction. Referring to FIGS. 13 and 14, the antenna module 1400 includes an antenna array 400 and RFICs 941 and 942.

The antenna array 400 includes flat-plate-shaped antenna elements 411 to 418, flat-plate-shaped isolation elements 419 to 422, a dielectric substrate 450, and a ground electrode 491. The antenna elements 411 to 418 face the ground electrode 491 with the dielectric substrate 450 interposed therebetween. The dielectric substrate 450 may be formed of a plurality of dielectric layers or may be formed of a single body.

The dielectric substrate 450 includes a part P41, a part P42, and a part P43. The part P43 connects the part P41 and the part P42 to each other. The thickness of the part P41 in the Z-axis direction (direction normal to antenna elements 411, 413, 415, and 417) is larger than the thickness of the part P43 in the Z-axis direction (direction normal to isolation elements 419 to 422). The thickness of the part P42 in the Z-axis direction (direction normal to antenna elements 412, 414, 416, and 418) is larger than the thickness of the part P43 in the Z-axis direction. A slit Slt4 is formed in the dielectric substrate 450 along the Y-axis direction between the part P41 and the part P42.

The effective dielectric constant of the dielectric substrate 450 in which the slit Slt4 is formed is smaller than the effective dielectric constant would be if the slit Slt4 were not formed. It is more difficult for a radio-frequency signal to pass through the slit Slt4, which is not filled with the dielectric, than through the dielectric substrate 450. The isolation of the antenna elements 411, 413, 415, and 417 and the antenna elements 412, 414, 416, and 418 can be further improved by forming the slit Slt4 in the dielectric substrate 450.

The antenna elements 411, 413, 415, and 417 are formed on a surface of the part P41. The antenna elements 412, 414, 416, and 418 are formed on a surface of the part P42. The isolation elements 419 to 422 are formed on a surface of the part P43. The isolation elements 419 to 422 are arrayed with spaces therebetween in the Y-axis direction.

In a plan view from the Z-axis direction, the isolation element 419 is formed between the antenna element 411 and the antenna element 412. The isolation element 419 faces the ground electrode 491 with the dielectric substrate 450 interposed therebetween.

In a plan view from the Z-axis direction, the isolation element 419 is spaced apart from the antenna element 411. In a plan view from the Z-axis direction, the isolation element 419 is spaced apart from the antenna element 412.

The distance between the antenna element 411 and the ground electrode 491 is larger than the distance between the isolation element 419 and the ground electrode 491. The distance between the antenna element 412 and the ground electrode 491 is larger than the distance between the isolation element 419 and the ground electrode 491.

In a plan view from the Z-axis direction, the isolation element 420 is formed between the antenna element 413 and the antenna element 414. The isolation element 420 faces the ground electrode 491 with the dielectric substrate 450 interposed therebetween.

In a plan view from the Z-axis direction, the isolation element 420 is spaced apart from the antenna element 413. In a plan view from the Z-axis direction, the isolation element 420 is spaced apart from the antenna element 414.

The distance between the antenna element 413 and the ground electrode 491 is larger than the distance between the isolation element 420 and the ground electrode 491. The distance between the antenna element 414 and the ground electrode 491 is larger than the distance between the isolation element 420 and the ground electrode 491.

In a plan view from the Z-axis direction, the isolation element 421 is formed between the antenna element 415 and the antenna element 416. The isolation element 421 faces the ground electrode 491 with the dielectric substrate 450 interposed therebetween.

In a plan view from the Z-axis direction, the isolation element 421 is spaced apart from the antenna element 415. In a plan view from the Z-axis direction, the isolation element 421 is spaced apart from the antenna element 416.

The distance between the antenna element 415 and the ground electrode 491 is larger than the distance between the isolation element 421 and the ground electrode 491. The distance between the antenna element 416 and the ground electrode 491 is larger than the distance between the isolation element 421 and the ground electrode 491.

In a plan view from the Z-axis direction, the isolation element 422 is formed between the antenna element 417 and the antenna element 418. The isolation element 422 faces the ground electrode 491 with the dielectric substrate 450 interposed therebetween.

In a plan view from the Z-axis direction, the isolation element 422 is spaced apart from the antenna element 417.

In a plan view from the Z-axis direction, the isolation element 422 is spaced apart from the antenna element 418.

The distance between the antenna element 417 and the ground electrode 491 is larger than the distance between the isolation element 422 and the ground electrode 491. The distance between the antenna element 418 and the ground electrode 491 is larger than the distance between the isolation element 422 and the ground electrode 491.

The ground electrode 491 is formed between the dielectric substrate 450 and the RFIC 941 and between the dielectric substrate 450 and the RFIC 942. In a plan view from the Z-axis direction, the antenna element 412 and the antenna element 414 overlap the RFIC 941. In addition, the antenna element 416 and the antenna element 418 overlap the RFIC 942.

On the other hand, in a plan view from the Z-axis direction, the antenna element 411 and the antenna element 413 do not overlap the RFIC 941. Furthermore, in a plan view from the Z-axis direction, the antenna element 415 and the antenna element 417 do not overlap the RFIC 942.

A via conductor 431 connects the antenna element 411 and a line conductor pattern 443 to each other. The line conductor pattern 443 is formed between the isolation element 419 and the ground electrode 491. A via conductor 432 penetrates through the ground electrode 491 and connects the line conductor pattern 443 and the RFIC 941 to each other. The via conductor 432 is insulated from the ground electrode 491.

The via conductor 431, the line conductor pattern 443, and the via conductor 432 form a power supply wiring line that connects the antenna element 411 and the RFIC 941 to each other. The RFIC 941 supplies a radio-frequency signal to the antenna element 411 via the power supply wiring line.

A via conductor 433 penetrates through the ground electrode 491 and connects the antenna element 412 and the RFIC 941 to each other. The via conductor 433 is insulated from the ground electrode 491. The RFIC 941 supplies a radio-frequency signal to the antenna element 412 through the via conductor 433.

A via conductor 434 connects the antenna element 413 and a line conductor pattern 444 to each other. The line conductor pattern 444 is formed between the isolation element 420 and the ground electrode 491. A via conductor 435 penetrates through the ground electrode 491 and connects the line conductor pattern 444 and the RFIC 941 to each other. The via conductor 435 is insulated from the ground electrode 491.

The via conductor 434, the line conductor pattern 444, and the via conductor 435 form a power supply wiring line that connects the antenna element 413 and the RFIC 941 to each other. This power supply wiring line passes between the isolation element 420 and the ground electrode 491.

A via conductor 436 penetrates through the ground electrode 491 and connects the antenna element 414 and the RFIC 941 to each other. The via conductor 436 is insulated from the ground electrode 491. The RFIC 941 supplies a radio-frequency signal to the antenna element 414 through the via conductor 436.

A via conductor 437 connects the antenna element 415 and a line conductor pattern 445 to each other. The line conductor pattern 445 is formed between the isolation element 421 and the ground electrode 491. A via conductor 438 penetrates through the ground electrode 491 and connects the line conductor pattern 445 and the RFIC 942 to each other. The via conductor 438 is insulated from the ground electrode 491.

The via conductor 437, the line conductor pattern 445, and the via conductor 438 form a power supply wiring line that connects the antenna element 415 and the RFIC 942 to each other. This power supply wiring line passes between the isolation element 421 and the ground electrode 491.

A via conductor 439 penetrates through the ground electrode 491 and connects the antenna element 416 and the RFIC 942 to each other. The via conductor 439 is insulated from the ground electrode 491. The RFIC 942 supplies a radio-frequency signal to the antenna element 416 through the via conductor 436.

A via conductor 440 connects the antenna element 417 and a line conductor pattern 446 to each other. The line conductor pattern 446 is formed between the isolation element 422 and the ground electrode 491. A via conductor 441 penetrates through the ground electrode 491 and connects the line conductor pattern 446 and the RFIC 942 to each other. The via conductor 441 is insulated from the ground electrode 491.

The via conductor 440, the line conductor pattern 446, and the via conductor 441 form a power supply wiring line that connects the antenna element 417 and the RFIC 942 to each other. This power supply wiring line passes between the isolation element 422 and the ground electrode 491.

A via conductor 442 penetrates through the ground electrode 491 and connects the antenna element 418 and the RFIC 942 to each other. The via conductor 442 is insulated from the ground electrode 491. The RFIC 942 supplies a radio-frequency signal to the antenna element 418 through the via conductor 442.

The slit Slt4 can be formed up to a depth at which the isolation elements 419 to 422 are exposed to the outside by forming the power supply wiring lines that connect the antenna elements 411 and 413 and the RFIC 941 to each other and the power supply wiring lines that connect the antenna elements 415 and 417 and the RFIC 942 to each other so as to pass between the isolation elements 419 to 422 and the ground electrode 491.

In a plan view from the Z-axis direction, the effective dielectric constant of the dielectric substrate 450 can be made smaller than it would be if the power supply wiring lines were to pass over the isolation elements 419 to 422. As a result, the isolation characteristic of the antenna array 400 can be further improved.

Two or more adjacent isolation elements among the isolation elements 419 to 422 may be formed so as to be integrated with each other. However, in the case of this configuration, unwanted resonance may be generated depending on the length (size in Y-axis direction) of the isolation elements. Therefore, it is desirable that the plurality of isolation elements 419 to 422 be formed so as to be separated from each other.

In embodiment 4, a case has been described in which the line conductor patterns 443 and 444, which form power supply wiring lines that connect the antenna elements 411 and 413 and RFIC 941 to each other, and the line conductor patterns 445 and 446, which form power supply wiring lines that connect the antenna elements 415 and 417 and the RFIC 942 to each other, are microstrip lines that face the ground electrode 491. These power supply wiring lines may be strip lines that pass between ground electrodes that face each other.

Figure 15:
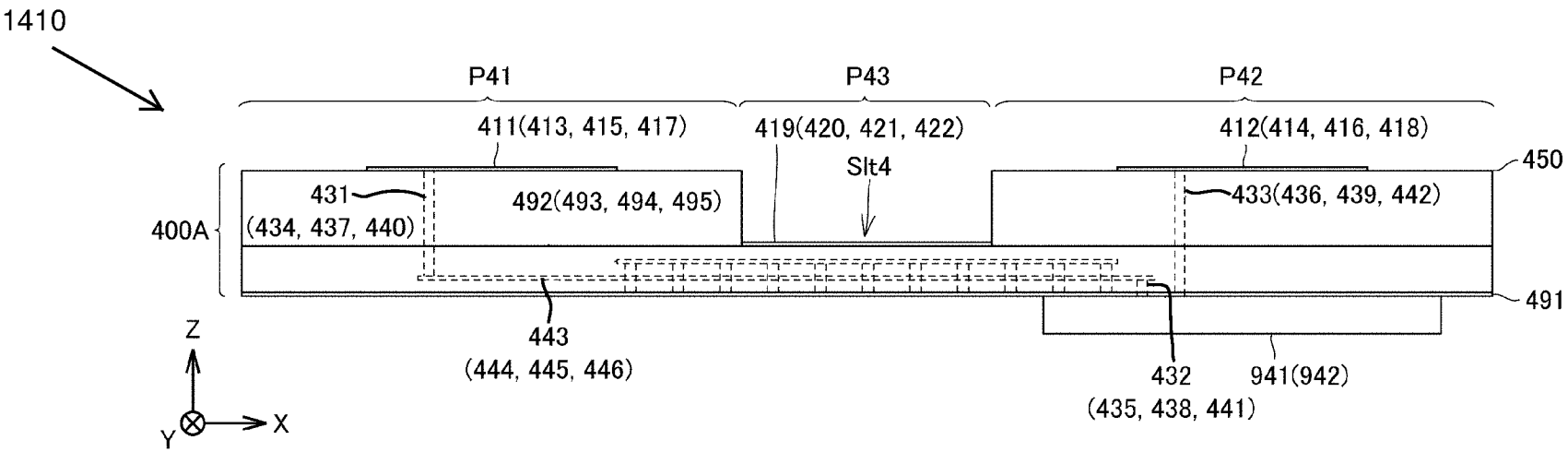
FIG. 15 is a plan view of an antenna module according to a modification of embodiment 4 from a Y-axis direction.

FIG. 15 is a plan view of an antenna module 1410 according to a modification of embodiment 4 from a Y-axis direction. The antenna module 1410 has a configuration in which the line conductor patterns 443 to 446 of the antenna module 1400 in FIGS. 13 and 14 are interposed between the ground electrode 491 and ground electrodes 492 to 495. The rest of the configuration is identical and therefore description thereof will not be repeated.

As illustrated in FIG. 15, the ground electrode 492 is formed between the isolation element 419 and the ground electrode 491. The ground electrode 492 is connected to the ground electrode 491 by a plurality of via conductors. The line conductor pattern 443 is formed between the ground electrode 491 and the ground electrode 492. The line conductor pattern 443, which forms a power supply wiring line that connects the antenna element 411 and the RFIC 941 to each other, is a strip line that passes between the ground electrode 491 and the ground electrode 492.

The ground electrode 493 is formed between the isolation element 420 and the ground electrode 491. The ground electrode 493 is connected to the ground electrode 491 by a plurality of via conductors. The line conductor pattern 444 is formed between the ground electrode 491 and the ground electrode 493. The line conductor pattern 444, which forms a power supply wiring line that connects the antenna element 413 and the RFIC 941 to each other, is a strip line that passes between the ground electrode 491 and the ground electrode 493.

The ground electrode 494 is formed between the isolation element 421 and the ground electrode 491. The ground electrode 494 is connected to the ground electrode 491 by a plurality of via conductors. The line conductor pattern 445 is formed between the ground electrode 491 and the ground electrode 494. The line conductor pattern 445, which forms a power supply wiring line that connects the antenna element 415 and the RFIC 942 to each other, is a strip line that passes between the ground electrode 491 and the ground electrode 494.

The ground electrode 495 is formed between the isolation element 422 and the ground electrode 491. The ground electrode 495 is connected to the ground electrode 491 by a plurality of via conductors. The line conductor pattern 446 is formed between the ground electrode 491 and the ground electrode 495. The line conductor pattern 446, which forms a power supply wiring line that connects the antenna element 417 and the RFIC 942 to each other, is a strip line that passes between the ground electrode 491 and the ground electrode 495.

Loss in the power supply wiring lines can be reduced and additionally the effect of electromagnetic waves from the outside can be reduced by using strip lines as the line conductor patterns forming the power supply wiring lines compared with the case where micro strip lines are used.

According to the antenna arrays of embodiment 4 and the modification described above, the isolation characteristic can be improved.

Embodiment 5

A case in which directions that are normal to antenna elements included in an antenna array are parallel to each other has been described in embodiments 1 to 4. In embodiment 5, a case in which directions that are normal to antenna elements included in an antenna array are not parallel to each other will be described.

Figure 16:
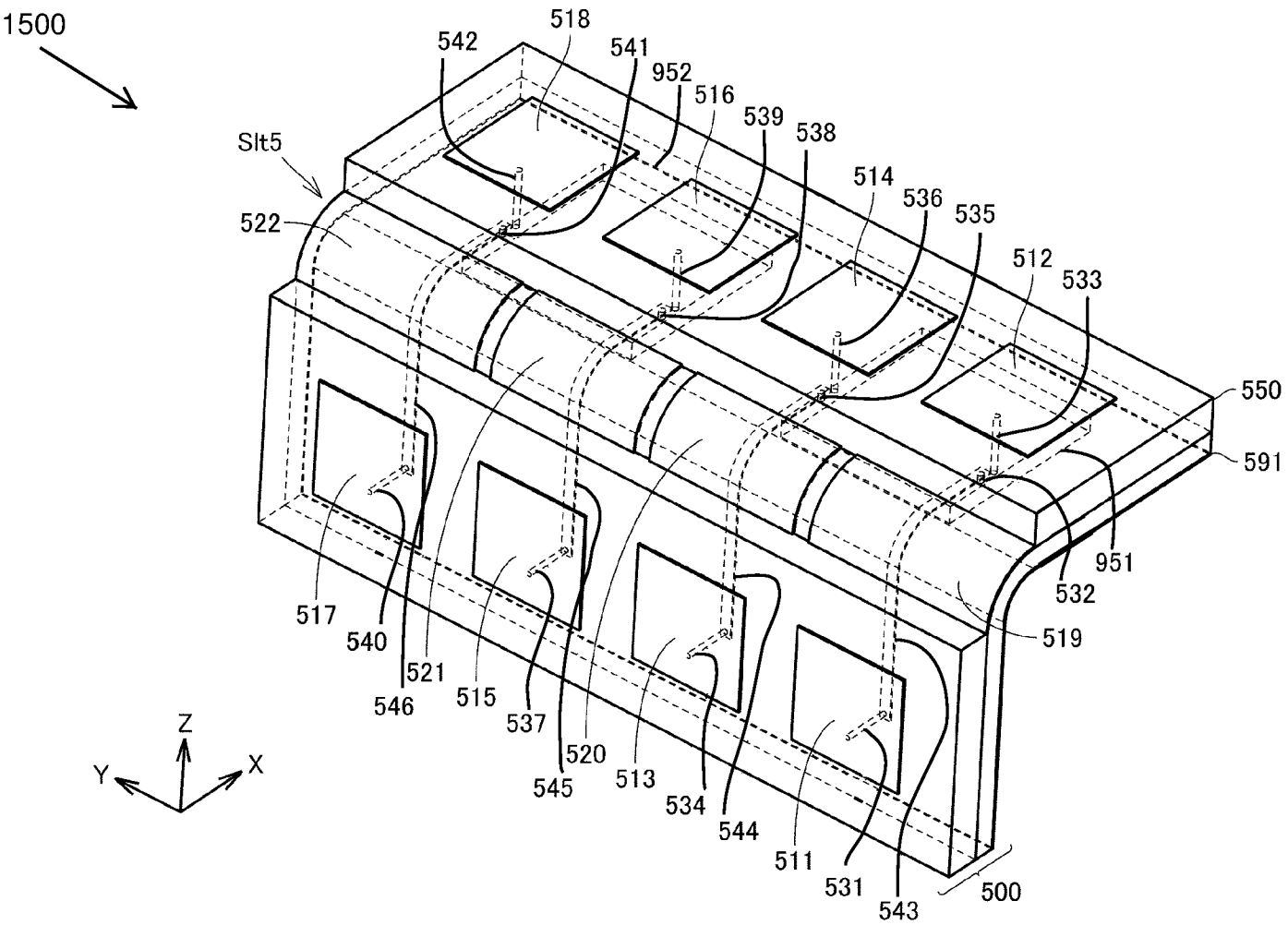
FIG. 16 is an external perspective view of an antenna module according to embodiment 5.
Figure 17:
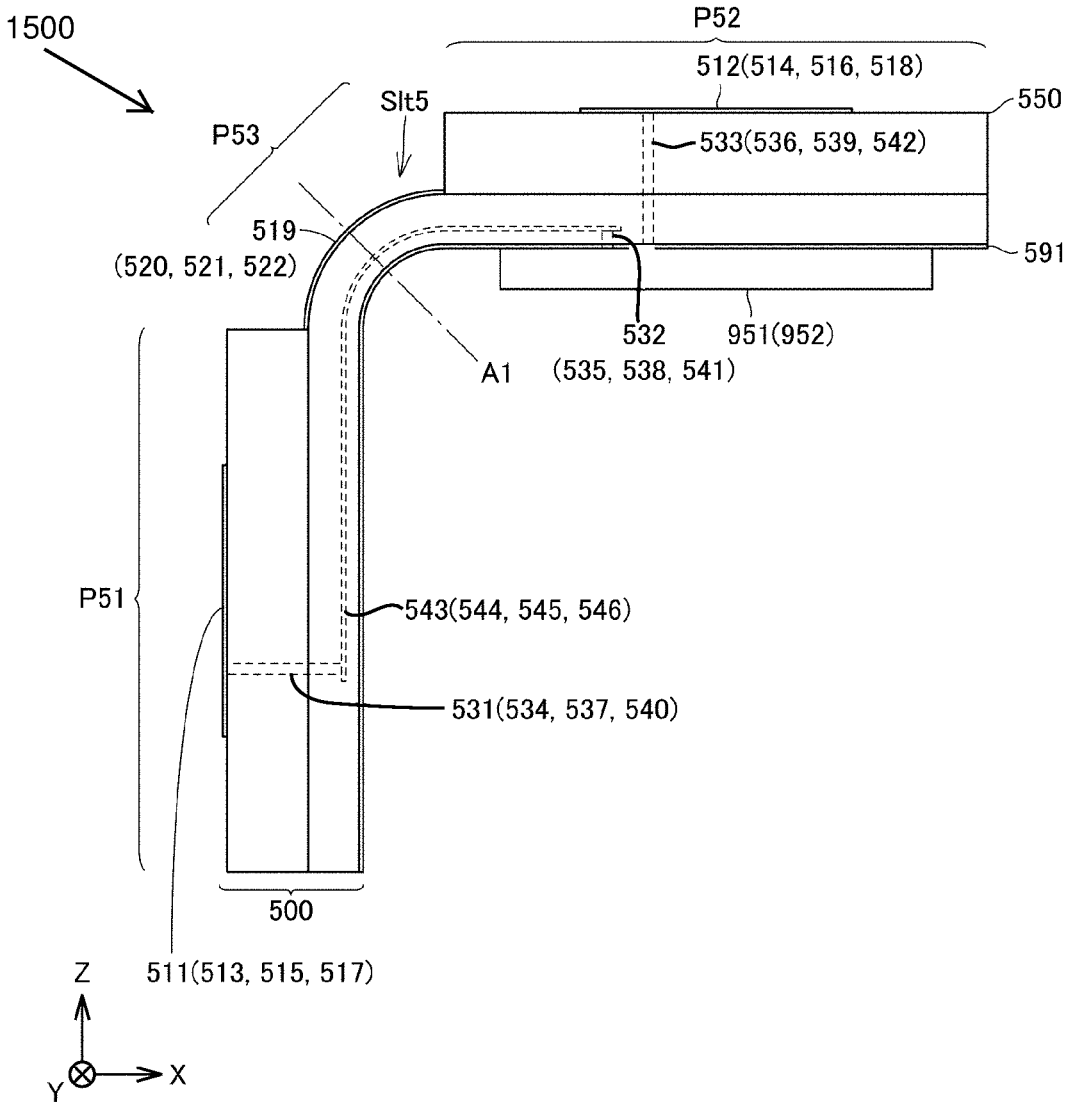
FIG. 17 is a plan view of the antenna module in FIG. 16 from a Y-axis direction.

FIG. 16 is an external perspective view of an antenna module 1500 according to embodiment 5. FIG. 17 is a plan view of the antenna module 1500 in FIG. 16 from the Y-axis direction.

Referring to FIGS. 16 and 17, the antenna module 1500 includes an antenna array 500 and RFICs 951 and 952.

The antenna array 500 includes flat-plate-shaped antenna elements 511 to 518, flat-plate-shaped isolation elements 519 to 522, a dielectric substrate 550, and a ground electrode 591. The antenna elements 511 to 518 face the ground electrode 591 with the dielectric substrate 550 interposed therebetween. The dielectric substrate 550 may be formed of a plurality of dielectric layers or may be formed of a single body.

The dielectric substrate 550 includes a part P51, a part P52, and a part P53. The part P53 connects the part P51 and the part P52 to each other. The dielectric substrate 550 is bent in the part P53. The antenna elements 511, 513, 515, and 517 are formed on a surface of the part P51. The antenna elements 512, 514, 516, and 518 are formed on a surface of the part P52. The isolation elements 519 to 522 are formed on a surface of the part P53. The isolation elements 519 to 522 are arrayed with spaces therebetween in the Y-axis direction. The isolation elements 519 to 522 may be formed so as to be integrated with each other.

Since the dielectric substrate 550 is bent in the part P53, a direction normal to the antenna elements 511, 513, 515, and 517 (X-axis direction) and a direction normal to the antenna elements 512, 514, 516, and 518 (Z-axis direction) are different from each other. In the antenna module 1500, transmission and reception of radio-frequency signals having polarizations whose excitation directions are different from each other are facilitated in comparison to a case where directions normal to a plurality of antenna elements included in an antenna array are parallel to each other.

The thickness of the part P51 in the X-axis direction (direction normal to antenna elements 511, 513, 515, and 517) is larger than the thickness of the part P53 in a direction of a specific axis A1 (direction normal to isolation elements 519 to 522). The thickness of the part P52 in the Z-axis direction (direction normal to antenna elements 512, 514, 516, and 518) is larger than the thickness of the part P53 in the direction of the specific axis A1. A slit Slt5 is formed in the dielectric substrate 550 along the Y-axis direction between the part P51 and the part P52.

The effective dielectric constant of the dielectric substrate 550 in which the slit Slt5 is formed is smaller than the effective dielectric constant would be if the slit Slt5 were not formed. It is more difficult for a radio-frequency signal to pass through the slit Slt5, which is not filled with the dielectric, than through the dielectric substrate 550. The isolation of the antenna elements 511, 513, 515, and 517 and the antenna elements 512, 514, 516, and 518 can be further improved by forming the slit Slt5 in the dielectric substrate 550.

In a plan view from the direction of the specific axis A1, the isolation element 519 is formed between the antenna element 511 and the antenna element 512. The isolation element 519 faces the ground electrode 591 with the dielectric substrate 550 interposed therebetween.

In a plan view from the X-axis direction, the isolation element 519 is spaced apart from the antenna element 511. In a plan view from the Z-axis direction, the isolation element 519 is spaced apart from the antenna element 512.

The distance between the antenna element 511 and the ground electrode 591 is larger than the distance between the isolation element 519 and the ground electrode 591. The distance between the antenna element 512 and the ground electrode 591 is larger than the distance between the isolation element 519 and the ground electrode 591.

In a plan view from the direction of the specific axis A1, the isolation element 520 is formed between the antenna element 513 and the antenna element 514. The isolation element 520 faces the ground electrode 591 with the dielectric substrate 550 interposed therebetween.

In a plan view from the Z-axis direction, the isolation element 420 is spaced apart from the antenna element 513. In a plan view from the Z-axis direction, the isolation element 520 is spaced apart from the antenna element 514.

The distance between the antenna element 513 and the ground electrode 591 is larger than the distance between the isolation element 520 and the ground electrode 591. The distance between the antenna element 514 and the ground electrode 591 is larger than the distance between the isolation element 520 and the ground electrode 591.

In a plan view from the direction of the specific axis A1, the isolation element 521 is formed between the antenna element 515 and the antenna element 516. The isolation element 521 faces the ground electrode 591 with the dielectric substrate 550 interposed therebetween.

In a plan view from the X-axis direction, the isolation element 521 is spaced apart from the antenna element 515. In a plan view from the Z-axis direction, the isolation element 521 is spaced apart from the antenna element 516.

The distance between the antenna element 515 and the ground electrode 591 is larger than the distance between the isolation element 521 and the ground electrode 591. The distance between the antenna element 516 and the ground electrode 591 is larger than the distance between the isolation element 521 and the ground electrode 591.

In a plan view from the direction of the specific axis A1, the isolation element 522 is formed between the antenna element 517 and the antenna element 518. The isolation element 522 faces the ground electrode 591 with the dielectric substrate 550 interposed therebetween.

In a plan view from the X-axis direction, the isolation element 522 is spaced apart from the antenna element 517. In a plan view from the Z-axis direction, the isolation element 522 is spaced apart from the antenna element 518.

The distance between the antenna element 517 and the ground electrode 591 is larger than the distance between the isolation element 522 and the ground electrode 591. The distance between the antenna element 518 and the ground electrode 591 is larger than the distance between the isolation element 522 and the ground electrode 591.

The ground electrode 591 is formed between the dielectric substrate 550 and the RFIC 951 and between the dielectric substrate 550 and the RFIC 952. In a plan view from the Z-axis direction, the antenna element 512 and the antenna element 514 overlap the RFIC 951. In addition, the antenna element 516 and the antenna element 518 overlap the RFIC 952.

On the other hand, in a plan view from the X-axis direction, the antenna element 511 and the antenna element 513 do not overlap the RFIC 951. In addition, the antenna element 515 and the antenna element 517 do not overlap the RFIC 952.

A via conductor 531 connects the antenna element 511 and a line conductor pattern 543 to each other. The line conductor pattern 543 is formed between the isolation element 519 and the ground electrode 591. A via conductor 532 penetrates through the ground electrode 591 and connects the line conductor pattern 543 and the RFIC 951 to each other. The via conductor 532 is insulated from the ground electrode 591.

The via conductor 531, the line conductor pattern 543, and the via conductor 532 form a power supply wiring line that connects the antenna element 511 and the RFIC 951 to each other. The RFIC 951 supplies a radio-frequency signal to the antenna element 511 via the power supply wiring line.

A via conductor 533 penetrates through the ground electrode 591 and connects the antenna element 512 and the RFIC 951 to each other. The via conductor 533 is insulated from the ground electrode 591. The RFIC 951 supplies a radio-frequency signal to the antenna element 512 through the via conductor 533.

A via conductor 534 connects the antenna element 513 and a line conductor pattern 544 to each other. The line conductor pattern 544 is formed between the isolation element 520 and the ground electrode 591. A via conductor 535 penetrates through the ground electrode 591 and connects the line conductor pattern 544 and the RFIC 951 to each other. The via conductor 535 is insulated from the ground electrode 591.

The via conductor 534, the line conductor pattern 544, and the via conductor 535 form a power supply wiring line that connects the antenna element 513 and the RFIC 951 to each other. This power supply wiring line passes between the isolation element 520 and the ground electrode 591.

A via conductor 536 penetrates through the ground electrode 591 and connects the antenna element 514 and the RFIC 951 to each other. The via conductor 536 is insulated from the ground electrode 591. The RFIC 951 supplies a radio-frequency signal to the antenna element 514 through the via conductor 536.

A via conductor 537 connects the antenna element 515 and a line conductor pattern 545 to each other. The line conductor pattern 545 is formed between the isolation element 521 and the ground electrode 591. A via conductor 538 penetrates through the ground electrode 591 and connects the line conductor pattern 545 and the RFIC 952 to each other. The via conductor 538 is insulated from the ground electrode 591.

The via conductor 537, the line conductor pattern 545, and the via conductor 538 form a power supply wiring line that connects the antenna element 515 and the RFIC 952 to each other. This power supply wiring line passes between the isolation element 521 and the ground electrode 591.

A via conductor 539 penetrates through the ground electrode 591 and connects the antenna element 516 and the RFIC 952 to each other. The via conductor 539 is insulated from the ground electrode 591. The RFIC 952 supplies a radio-frequency signal to the antenna element 516 through the via conductor 539.

A via conductor 540 connects the antenna element 517 and a line conductor pattern 546 to each other. The line conductor pattern 546 is formed between the isolation element 522 and the ground electrode 591. A via conductor 541 penetrates through the ground electrode 591 and connects the line conductor pattern 546 and the RFIC 952 to each other. The via conductor 541 is insulated from the ground electrode 591.

The via conductor 540, the line conductor pattern 546, and the via conductor 541 form a power supply wiring line that connects the antenna element 517 and the RFIC 952 to each other. This power supply wiring line passes between the isolation element 522 and the ground electrode 591.

A via conductor 542 penetrates through the ground electrode 591 and connects the antenna element 518 and the RFIC 952 to each other. The via conductor 542 is insulated from the ground electrode 591. The RFIC 952 supplies a radio-frequency signal to the antenna element 518 through the via conductor 542.

The slit Slt5 can be formed up to a depth at which the isolation elements 519 to 522 are exposed to the outside by forming the power supply wiring lines that connect the antenna elements 511 and 513 and the RFIC 951 to each other and the power supply wiring lines that connect the antenna elements 515 and 517 and the RFIC 952 to each other so as to pass between the isolation elements 519 to 522 and the ground electrode 591. In a plan view from the direction of the specific axis A1, the effective dielectric constant of the dielectric substrate 550 can be made smaller than it would be if the power supply wiring lines were to pass over the isolation elements 519 to 522. As a result, the isolation characteristic of the antenna array 500 can be further improved.

In embodiment 5, a case has been described in which the line conductor patterns 543 and 544, which form power supply wiring lines that connect the antenna elements 511 and 513 and RFIC 951 to each other, and the line conductor patterns 545 and 546, which form power supply wiring lines that connect the antenna elements 515 and 517 and the RFIC 952 to each other, are microstrip lines that face the ground electrode 591. The line conductor patterns that form the power supply wiring lines may be strip lines that pass between ground electrodes that face each other.

Figure 18:
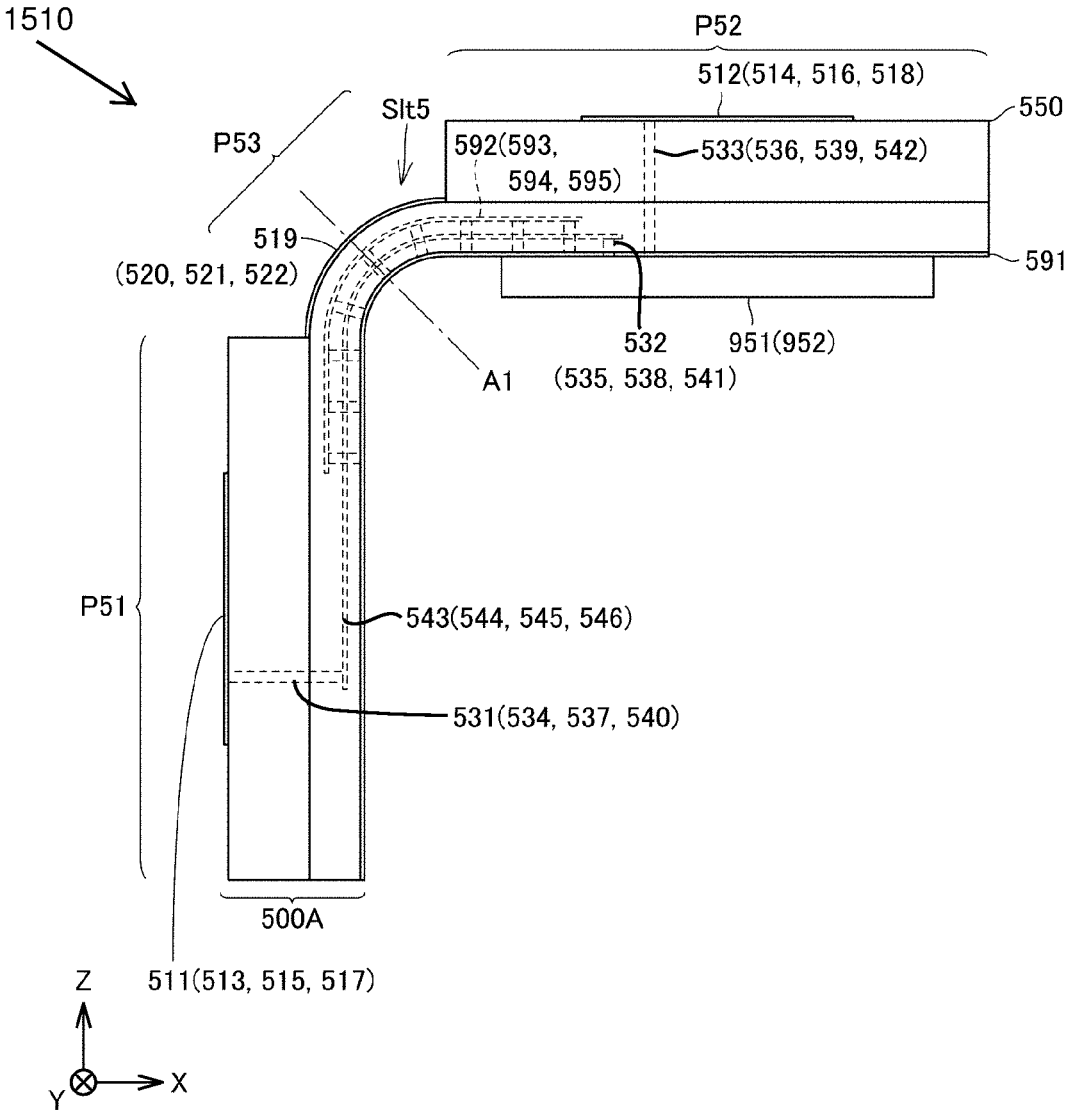
FIG. 18 is a plan view of an antenna module according to a modification of embodiment 5 from a Y-axis direction.

FIG. 18 is a plan view of an antenna module 1510 according to a modification of embodiment 5 from a Y-axis direction. The antenna module 1510 has a configuration in which the line conductor patterns 543 to 546 of the antenna module 1500 in FIGS. 16 and 17 are interposed between the ground electrode 591 and ground electrodes 592 to 595. The rest of the configuration is identical and therefore description thereof will not be repeated.

As illustrated in FIG. 18, a ground electrode 592 is connected to the ground electrode 591 by a plurality of via conductors. The line conductor pattern 443 is formed between the ground electrode 591 and the ground electrode 592. The line conductor pattern 543, which forms a power supply wiring line that connects the antenna element 511 and the RFIC 951 to each other, is a strip line that passes between the ground electrode 591 and the ground electrode 592.

A ground electrode 593 is formed between the isolation element 520 and the ground electrode 591. The ground electrode 593 is connected to the ground electrode 591 by a plurality of via conductors. The line conductor pattern 544 is formed between the ground electrode 591 and the ground electrode 593. The line conductor pattern 544, which forms a power supply wiring line that connects the antenna element 513 and the RFIC 951 to each other, is a strip line that passes between the ground electrode 591 and the ground electrode 593.

A ground electrode 594 is formed between the isolation element 521 and the ground electrode 591. The ground electrode 594 is connected to the ground electrode 591 by a plurality of via conductors. The line conductor pattern 545 is formed between the ground electrode 591 and the ground electrode 594. The line conductor pattern 545, which forms a power supply wiring line that connects the antenna element 515 and the RFIC 952 to each other, is a strip line that passes between the ground electrode 591 and the ground electrode 594.

A ground electrode 595 is formed between the isolation element 522 and the ground electrode 591. The ground electrode 595 is connected to the ground electrode 591 by a plurality of via conductors. The line conductor pattern 546 is formed between the ground electrode 591 and the ground electrode 595. The line conductor pattern 546, which forms a power supply wiring line that connects the antenna element 517 and the RFIC 952 to each other, is a strip line that passes between the ground electrode 591 and the ground electrode 595.

Loss in the power supply wiring lines can be reduced and additionally the effect of electromagnetic waves from the outside can be reduced by using strip lines as the line conductor patterns forming the power supply wiring lines compared with the case where micro strip lines are used.

In embodiment 5 and the modification, a case has been described in which a plurality of antenna elements are arranged in the Y-axis direction (first direction) on each of the surface of the part P51 (first part) and the surface of the part P52 (second part), which have different normal directions. The arrangement of the plurality of antenna elements on the surface of the first part and the surface of the second part is not limited to an arrangement along the first direction. The plurality of antenna elements may be arranged in a second direction, which is different from the first direction, or may be arranged in a matrix along the first direction and the second direction on the surface of the first part and the surface of the second part. Furthermore, isolation elements may be arranged between adjacent antenna elements on the surface of the first part and the surface of the second part.

According to the antenna arrays of embodiment 5 and the modification described above, the isolation characteristic can be improved.

In embodiments 1 to 5, antenna arrays have been described in which isolation elements are arranged between flat-plate-shaped antenna elements (patch antennas). In the antenna arrays according to the embodiments, the isolation elements may be each arranged between two antenna elements at least one of which is different from a patch antenna. For example, the isolation elements in the antenna arrays according to the embodiments may be arranged between a patch antenna and a dipole antenna or may be arranged between dipole antennas. As in the first to fifth embodiments, the isolation characteristic can be improved by an antenna array in which an isolation element is arranged between two antenna elements at least one of which is different from a patch antenna.

Is also intended that the presently disclosed embodiments be combined with each other as appropriate provided that there are no resulting inconsistencies. The presently disclosed embodiments are illustrative in all points and should not be considered as limiting. The scope of the present disclosure is not defined by the above description but rather by the scope of the claims and it is intended that equivalents to the scope of the claims and all modifications within the scope of the claims be included within the scope of the present disclosure.

The first antenna element and the second antenna element do not have to be formed on a surface of the dielectric substrate and may instead be formed inside the dielectric substrate. In addition, the first ground electrode does not have to be formed on a rear surface of the dielectric substrate and may instead be formed inside the dielectric substrate.

REFERENCE SIGNS LIST

10, 100, 200, 300, 400, 500 antenna array,
10A to 10D, 111, 112, 211, 212, 311, 312, 411, 412, 413 to 418, 511 to 518 antenna element,
31A to 31D, 33A to 33D, 37 switch,
32AR, 32BR, 32CR, 32DR low-noise amplifier,
32AT, 32BT, 32CT, 32DT power amplifier,
34A to 34D attenuator,
35A to 35D signal multiplexer/demultiplexer
36 demultiplexer
38 mixer,
39 amplification circuit,

113, 213, 313, 419 to 422, 519 to 522 isolation element,
131, 132, 231, 232, 331, 332, 431 to 442, 531 to 542 via conductor,
150, 250, 350, 450, 550 dielectric substrate,
190, 290, 390, 491 to 495, 591 to 595 ground electrode,
443 to 446, 543 to 546 line conductor pattern,
900, 910, 920, 930, 941, 942, 951, 952 RFIC,
1000, 1100, 1200, 1300, 1400, 1410, 1500, 1510 antenna module,
3000 communication device.

The invention claimed is:

1. An antenna array comprising:
a dielectric substrate;
a first antenna on or in the dielectric substrate, the first antenna having a flat-plate shape;
a second antenna on or in the dielectric substrate, the second antenna having a flat-plate shape;
an isolator on or in the dielectric substrate; and
a first ground electrode on or in the dielectric substrate, at least part of the dielectric substrate being between the first ground electrode and each of the first antenna, the second antenna, and the isolator, wherein:
as seen in a plan view along a first normal direction that is normal to the isolator, the isolator is between the first antenna and the second antenna,
a first distance between the first antenna and the first ground electrode is different than a second distance between the isolator and the first ground electrode,
a third distance between the second antenna and the first ground electrode is different than the second distance,
as seen in a plan view along a second normal direction that is normal to the first antenna, the isolator is separated from the first antenna,
as seen in a plan view along a third normal direction that is normal to the second antenna, the isolator is separated from the second antenna, and
the second normal direction and the third normal direction are not parallel with each other.

2. The antenna array according to claim 1, wherein the first distance and the third distance are greater than the second distance.

3. The antenna array according to claim 2, wherein the isolator is at a bottom of a recess in the dielectric substrate, and is exposed.

4. An antenna module comprising:
the antenna array according to claim 1; and
a radio-frequency processing circuit configured to supply a radio-frequency signal to the antenna array;
wherein the first ground electrode is between the radio-frequency processing circuit and the first antenna, the second antenna, and the isolator.

5. The antenna module according to claim 4, wherein
as seen in the plan view from the second normal direction, the radio-frequency processing circuit and the first antenna do not overlap,
as seen in the plan view from the third normal direction, the radio-frequency processing circuit and the second antenna overlap, and
a power supply wiring line that connects the first antenna and the radio-frequency processing circuit to each other passes between the isolator and the first ground electrode.

6. The antenna module according to claim 5, further comprising:
a second ground electrode between the isolator and the first ground electrode, wherein:
a fourth distance between the second ground electrode and the first ground electrode is less than the first distance and is less than the third distance, and
the power supply wiring line passes between the first ground electrode and the second ground electrode.

7. An antenna array for transmitting or receiving a radio-frequency signal having a wavelength, the antenna array comprising:
a dielectric substrate;
a first antenna on or in the dielectric substrate, the first antenna having a flat-plate shape;
a second antenna on or in the dielectric substrate, the second antenna having a flat-plate shape;
an isolator on or in the dielectric substrate; and
a first ground electrode on or in the dielectric substrate, at least part of the dielectric substrate being between the first ground electrode and each of the first antenna, the second antenna, and the isolator, wherein:
as seen in a plan view along a first normal direction that is normal to the isolator, the isolator is between the first antenna and the second antenna,
a first distance between the first antenna and the first ground electrode is equal to a second distance between the isolator and the first ground electrode,
a third distance between the second antenna and the first ground electrode is equal to the second distance,
as seen in a plan view along a second normal direction that is normal to the first antenna, the isolator is separated from the first antenna by a distance equal to 1/20 of the wavelength, and
as seen in a plan view along a third normal direction that is normal to the second antenna, the isolator is separated from the second antenna by a distance equal to 1/20 of the wavelength.

8. The antenna array according to claim 7, wherein the second normal direction and the third normal direction are not parallel with each other.

9. An antenna module comprising:
the Antenna array according to claim 7; and
a radio-frequency processing circuit configured to supply the radio-frequency signal to the antenna array;
wherein the first ground electrode is between the radio-frequency processing circuit and the first antenna, the second antenna, and the isolator.

10. The antenna module according to claim 9, wherein
as seen in the plan view from the second normal direction, the radio-frequency processing circuit and the first antenna do not overlap,
as seen in the plan view from the third normal direction, the radio-frequency processing circuit and the second antenna overlap, and
a power supply wiring line that connects the first antenna and the radio-frequency processing circuit to each other passes between the isolator and the first ground electrode.

11. The antenna module according to claim 10, further comprising:
a second ground electrode between the isolator and the first ground electrode, wherein:
a fourth distance between the second ground electrode and the first ground electrode is less than the first distance and is less than the third distance, and
the power supply wiring line passes between the first ground electrode and the second ground electrode.

12. The antenna array according to claim 7, wherein the dielectric substrate has a curved portion such that the second normal direction and the third normal direction are orthogonal to each other.

13. The antenna array according to claim 12, wherein the isolator is at a position in or on the dielectric substrate corresponding to the curved portion such that the isolator is also curved.

14. An antenna array comprising:

a dielectric substrate;

a first antenna on or in the dielectric substrate, the first antenna having a flat-plate shape;

a second antenna on or in the dielectric substrate, the second antenna having a flat-plate shape;

an isolator on or in the dielectric substrate; and a first ground electrode on or in the dielectric substrate, at least part of the dielectric substrate being between the first ground electrode and each of the first antenna, the second antenna, and the isolator, wherein:

as seen in a plan view along a first normal direction that is normal to the isolator, the isolator is between the first antenna and the second antenna, a first distance between the first antenna and the first ground electrode is different than a second distance between the isolator and the first ground electrode, a third distance between the second antenna and the first ground electrode is different than the second distance, as seen in a plan view along a second normal direction that is normal to the first antenna, the isolator is separated from the first antenna, as seen in a plan view along a third normal direction that is normal to the second antenna, the isolator is separated from the second antenna, and, the dielectric substrate has a curved portion such that the second normal direction and the third normal direction are orthogonal to each other.

15. The antenna array according to claim 14, wherein the isolator is at a position in or on the dielectric substrate corresponding to the curved portion such that the isolator is also curved.

* * * * *